US008665185B2

(12) United States Patent
Fan et al.

(10) Patent No.: US 8,665,185 B2
(45) Date of Patent: Mar. 4, 2014

(54) PIXEL UNIT OF ORGANIC LIGHT EMITTING DIODE AND DISPLAY PANEL FOR ACHIEVING STABLE BRIGHTNESS USING THE SAME

(75) Inventors: Ching-Lin Fan, Keelung (TW); Bo-Jhang Sun, Kaohsiung (TW)

(73) Assignee: National Taiwan University of Science and Technology, Taipei (TW)

( * ) Notice: Subject to any disclaimer, the term of this patent is extended or adjusted under 35 U.S.C. 154(b) by 232 days.

(21) Appl. No.: 13/092,977

(22) Filed: Apr. 25, 2011

(65) Prior Publication Data

US 2012/0162175 A1 Jun. 28, 2012

(30) Foreign Application Priority Data

Dec. 22, 2010 (TW) ..... 99145278 A

(51) Int. Cl.
*G09G 3/30* (2006.01)
*G09G 3/10* (2006.01)

(52) U.S. Cl.
USPC ..... 345/76; 315/169.3

(58) Field of Classification Search
CPC ..... G09G 2300/0842
USPC ..... 345/76; 315/169.3
See application file for complete search history.

(56) References Cited

U.S. PATENT DOCUMENTS 8,111,217 B2 * 2/2012 Caligiore et al. ..... 345/76
2005/0110730 A1 * 5/2005 Kim et al. ..... 345/82
2005/0140600 A1 * 6/2005 Kim et al. ..... 345/76
2005/0243036 A1 * 11/2005 Ikeda ..... 345/76
2005/0259051 A1 * 11/2005 Lee et al. ..... 345/76
2006/0043366 A1 * 3/2006 Ha et al. ..... 257/59
2006/0077134 A1 * 4/2006 Hector et al. ..... 345/76
2006/0097965 A1 * 5/2006 Deane et al. ..... 345/76
2006/0238461 A1 * 10/2006 Goh et al. ..... 345/76
2007/0063932 A1 * 3/2007 Nathan et al. ..... 345/76
2008/0074362 A1 * 3/2008 Ogura ..... 345/77
2008/0211746 A1 * 9/2008 Caligiore et al. ..... 345/76
2009/0096721 A1 * 4/2009 Chiou et al. ..... 345/76
2010/0001983 A1 * 1/2010 Abe ..... 345/76
2011/0115764 A1 * 5/2011 Chung ..... 345/76

OTHER PUBLICATIONS

Lin, et al., "A Novel Voltage-Feedback Pixel Circuit for AMOLED Displays," Journal of Display Technology, Mar. 2008, p. 54-60, vol. 4, No. 1.

Lin, et al., "A Novel LTPS-TFT Pixel Circuit Compensating for TFT Threshold-Voltage Shift and OLED Degradation for AMOLED," IEEE Electron Device Letters, Feb. 2007, p. 129-131, vol. 28, No. 2.

* cited by examiner

*Primary Examiner* — Adam J Snyder
(74) *Attorney, Agent, or Firm* — Jianq Chyun IP Office

(57) ABSTRACT

A pixel unit for driving an organic light emitting diode (OLED) is disclosed. The pixel unit includes a driving transistor, a compensating capacitor, a selecting switch module, a power switch and a configuration switch. One terminal of the compensating capacitor is coupled to a gate of the driving transistor. The selecting switch module provides the ground voltage or the compensating voltage to the other terminal of the compensating capacitor according to a first control signal. The power switch is coupled between a power voltage and a drain of the driving transistor and is controlled by a second control signal. The configuration switch receives the first control signal for controlling a connecting configuration of the driving transistor. The pixel unit is driven according to the first and the second control signals for compensating threshold voltage shifting of the OLED and the driving transistor.

2 Claims, 13 Drawing Sheets

PIXEL UNIT OF ORGANIC LIGHT EMITTING DIODE AND DISPLAY PANEL FOR ACHIEVING STABLE BRIGHTNESS USING THE SAME

CROSS-REFERENCE TO RELATED APPLICATION

This application claims the priority benefit of Taiwan application serial no. 99145278, filed Dec. 22, 2010. The entirety of the above-mentioned patent application is hereby incorporated by reference herein and made a part of this specification.

BACKGROUND

1. Field of the Invention

The invention relates to a pixel unit of an organic light emitting diode and a display panel using such pixel unit.

2. Description of Related Art

Referring to FIG. 1, FIG. 1 is a diagram illustrating a conventional pixel unit 100 of organic light emitting diode (OLED). An operation principle of the pixel unit 100 is approximately as follows. When a switch SW1 formed by a thin-film transistor is turned on in response to a control signal CTRL, a data signal VDATA is stored in a capacitor CC. Moreover, when the switch SW1 formed by the thin-film transistor is turned off in response to the control signal CTRL, a driving transistor DTFT formed by a thin-film transistor is turned on, and correspondingly generates a driving current according to a voltage stored in the capacitor CC, so as to drive an OLED OD1.

A following equation (1) represents a driving current I flowing through the OLED OD1:

$$I = \frac{1}{2}K(VGS - VTH)^2 \qquad \text{Equation (1)}$$

Where, k is a process parameter (constant) of the driving transistor DTFT, VGS is a voltage between a gate and a source of the driving transistor DTFT, and VTH is a threshold voltage of the driving transistor DTFT.

Since the threshold voltage VTH of the driving transistor DTFT can be shifted due to long time positive bias driving, when the threshold voltage VTH of the driving transistor DTFT is shifted, a magnitude of the driving current is directly influenced. Therefore, a brightness of the OLED OD1 is changed and is hard to be controlled. In order to achieve a stable brightness of the OLED OD1, it is an important issue to be developed to effectively compensate the shifting phenomenon of the threshold voltage VTH.

SUMMARY OF THE INVENTION

The invention is directed to a pixel unit for driving an organic light emitting diode (OLED), which can effectively compensate electrical decline of a driving transistor (process unevenness of the driving transistor).

The invention is directed to an OLED display panel, which can effectively compensate electrical decline of a driving transistor (process unevenness of the driving transistor).

The invention provides a pixel unit for driving an organic light emitting diode (OLED). The pixel unit includes a driving transistor, a compensating capacitor, a selecting switch module, a power switch and a configuration switch. The driving transistor has a drain, a source and a gate, and the source is coupled to the OLED. One terminal of the compensating capacitor is coupled to the gate of the driving transistor. The selecting switch module is coupled to another terminal of the compensating capacitor, a ground voltage and a compensating reference voltage, and provides the ground voltage or the compensating reference voltage to the other terminal of the compensating capacitor according to a first control signal. The power switch is coupled between a power voltage and the drain of the driving transistor and is controlled by a second control signal. The configuration switch is coupled between the drain of the driving transistor and the terminal of the compensating capacitor coupled to the gate of the driving transistor, and is controlled by the first control signal.

In an embodiment of the invention, the selecting switch module includes a first selecting switch and a second selecting switch. The first selecting switch is coupled in series between the ground voltage and the compensating capacitor, and is turned on or turned off according to the first control signal. One terminal of the second selecting switch is coupled to the compensating capacitor, and another terminal thereof receives a data signal with a negative value, where the data signal with the negative value is the compensating reference voltage. The second selecting switch is turned on or turned off according to the first control signal, and turned on/off states of the second selecting switch and the first selecting switch are complementary.

In an embodiment of the invention, during a pre-charge stage, the selecting switch module selectively provides the data signal with the negative value to the compensating capacitor according to the first control signal, the power switch is turned on according to the second control signal, and the configuration switch is turned on according to the first control signal.

In an embodiment of the invention, during a compensation stage, the selecting switch module selectively provides the data signal with the negative value to the compensating capacitor according to the first control signal, the power switch is turned off according to the second control signal, and the configuration switch is turned on according to the first control signal.

In an embodiment of the invention, the pixel unit further includes a data voltage switch. The data voltage switch is coupled between the OLED and a data signal, and is turned on or turned off according to the first control signal.

In an embodiment of the invention, the selecting switch module includes a first selecting switch and a second selecting switch. The first selecting switch is coupled in series between the ground voltage and the compensating capacitor, and is turned on or turned off according to the first control signal. One terminal of the second selecting switch is coupled to the compensating capacitor, and another terminal thereof is coupled to the OLED, where a threshold voltage of the OLED is the compensating reference voltage. The second selecting switch is turned on or turned off according to the first control signal, and a turned on state or a turned off state of the second selecting switch is complementary with a turned on state or a turned off state of the first selecting switch.

In an embodiment of the invention, during a pre-charge stage, the selecting switch module selectively provides the ground voltage to the compensating capacitor according to the first control signal, the power switch is turned on according to the second control signal, the configuration switch is turned on according to the first control signal, and the data voltage switch is turned on according to the first control signal.

The invention provides an organic light emitting diode (OLED) display panel including a plurality of pixel units arranged in an array for driving a plurality of OLEDs. Each of the pixel units includes a driving transistor, a compensating capacitor, a selecting switch module, a power switch and a configuration switch. The driving transistor has a drain, a source and a gate, and the source is coupled to the OLED. One terminal of the compensating capacitor is coupled to the gate of the driving transistor. The selecting switch module is coupled to another terminal of the compensating capacitor, a ground voltage and a compensating reference voltage, and provides the ground voltage or the compensating reference voltage to the other terminal of the compensating capacitor according to a first control signal. The power switch is coupled between a power voltage and the drain of the driving transistor and is controlled by a second control signal. The configuration switch is coupled between the drain of the driving transistor and one terminal of the compensating capacitor, and is controlled by the first control signal.

According to the above descriptions, based on a special coupling relationship of the selecting switch module, the power switch, the configuration switch and the compensating capacitor, the pixel unit is driven according to the first and the second control signals for compensating variation of electrical characteristics of the pixel unit caused by long time usage of the driving transistor.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
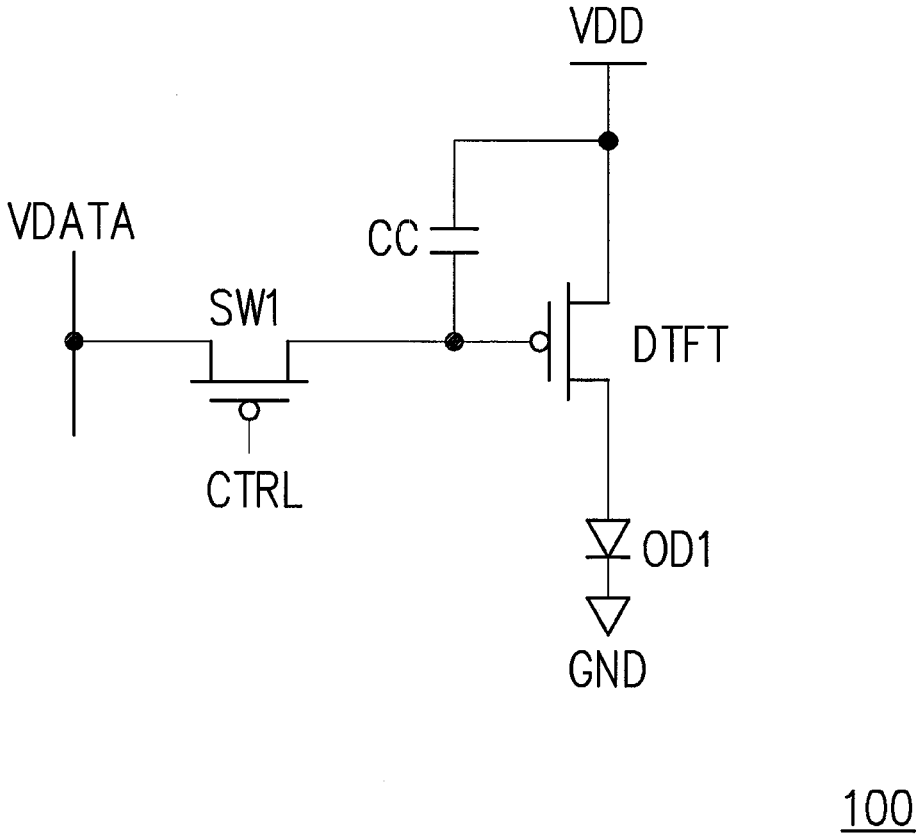
FIG. 1 (RELATED ART)
FIG. 1 is a diagram illustrating a conventional pixel unit 100 of an organic light emitting diode (OLED).
Figure 2:
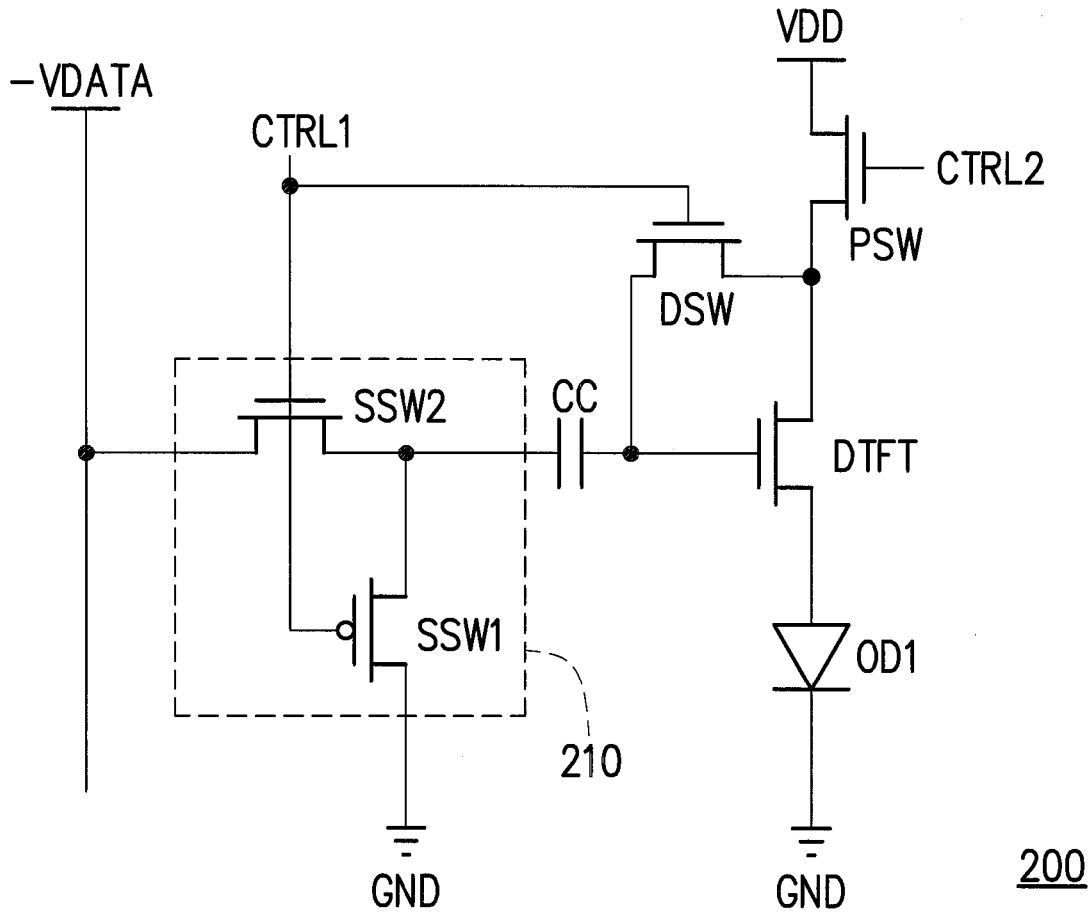
FIG. 2 is a schematic diagram of a pixel unit 200 according to an embodiment of the invention.

Referring to FIG. 2, FIG. 2 is a schematic diagram of a pixel unit 200 according to an embodiment of the invention. The pixel unit 200 is used for driving an organic light emitting diode (OLED) OD1. The pixel unit 200 includes a driving transistor DTFT, a compensating capacitor CC, a selecting switch module 210, a power switch PSW and a configuration switch DSW. The driving transistor DTFT has a drain, a source and a gate, and the source of the riving transistor DTFT is coupled to an anode of the OLED OD1, and a cathode of the OLED OD1 is coupled to a ground voltage GND. One terminal of the compensating capacitor CC is coupled to the gate of the driving transistor DTFT, and another terminal of the compensating capacitor CC is coupled to the selecting switch module 210. The selecting switch module 210 is coupled the ground voltage GND and a compensating reference voltage, and the selecting switch module 210 provides the ground voltage GND or a compensating reference voltage to the other terminal of the compensating capacitor CC according to a control signal CTRL1. In the present embodiment, the compensating reference voltage is a data signal −VDATA with a negative value.

In detail, in the present embodiment, the selecting switch module 210 includes a selecting switch SSW1 and a selecting switch SSW2. The selecting switch SSW1 is coupled in series between the ground voltage GND and the compensating capacitor CC, and is turned on or turned off according to the control signal CTRL1. The selecting switch SSW2 is coupled in series between the compensating capacitor CC and the data signal −VDATA with the negative value, and is turned on or turned off according to the control signal CTRL1. It should be noticed that turned on/off states of the selecting switches SSW1 and SSW2 are complementary, namely, when the selecting switch SSW1 is turned on, the selecting switch SSW2 is turned off. Comparatively, when the selecting switch SSW1 is turned off, the selecting switch SSW2 is turned on.

Further, when the selecting switch SSW2 is turned on according to the control signal CTRL1, the selecting switch SSW1 is correspondingly turned off. Now, the selecting switch module 210 provides the data signal −VDATA with the negative value to a terminal of the compensating capacitor CC coupled to the selecting switch module 210 through the turned-on selecting switch SSW2. Moreover, when the selecting switch SSW2 is turned off according to the control signal CTRL1, the selecting switch SSW1 is correspondingly turned on. Now, the selecting switch module 210 provides the ground voltage GND to the terminal of the compensating capacitor CC coupled to the selecting switch module 210 through the turned-on selecting switch SSW1.

The power switch PSW is coupled between a power voltage VDD and the drain of the driving transistor DTFT, and the power switch PSW is controlled by a control signal CTRL2. The configuration switch DSW is coupled between the drain of the driving transistor DTFT and one terminal of the compensating capacitor CC, and is controlled by the control signal CTRL1. When the configuration switch DSW is turned on according to the control signal CTRL1, the driving transistor DTFT is connected in a diode connection.

It should be noticed that the driving transistor DTFT, the selecting switches SSW1 and SSW2, the power switch PSW and the configuration switch DSW can all be implemented by thin-film transistors. The selecting switches SSW1 and SSW2 can be thin-film transistors with complementary types.

Figure 2A:
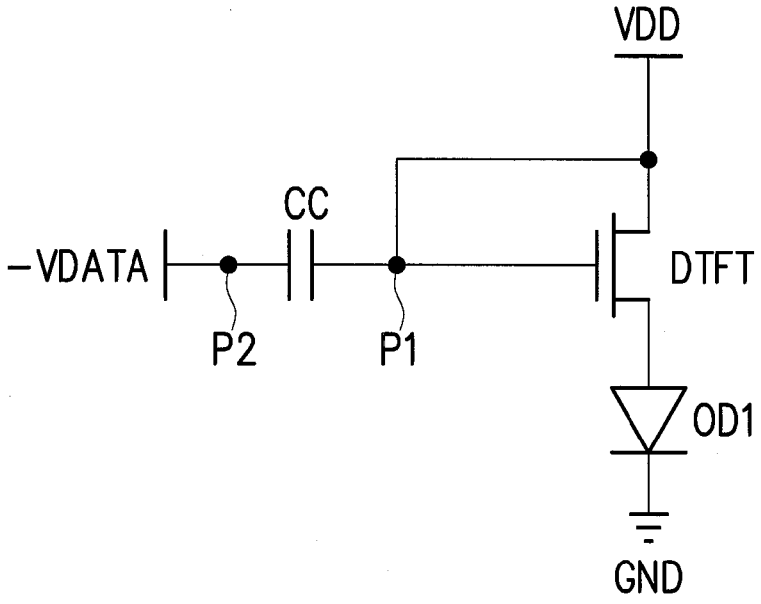
FIGS. 2A-2D are equivalent circuit diagrams of the pixel unit 200 of different stages according to an embodiment of the invention.

Referring to FIG. 2 and FIGS. 2A-2D for a driving method of the pixel unit 200, and FIGS. 2A-2D are equivalent circuit diagrams of the pixel unit 200 of different stages according to an embodiment of the invention. Referring to FIG. 2 and FIG. 2A, in the beginning of a driving cycle, a pre-charge stage is first entered. During the pre-charge stage, the selecting switch module 210 selectively provides the data signal −VDATA with the negative value to the compensating capacitor CC (a terminal P2) according to the control signal CTRL1. Namely, the selecting switch SSW1 is turned on according to the control signal CTRL1, and the selecting switch SSW2 is turned off according to the control signal CTRL1. The power switch PSW is turned on according to the control signal CTRL2, so that the power voltage VDD is directly connected to the drain and the gate of the driving transistor DTFT, and the configuration switch DSW is turned on according to the control signal CTRL1, so that the pixel unit 200 has an equivalent structure shown in FIG. 2A.

Figure 2B:
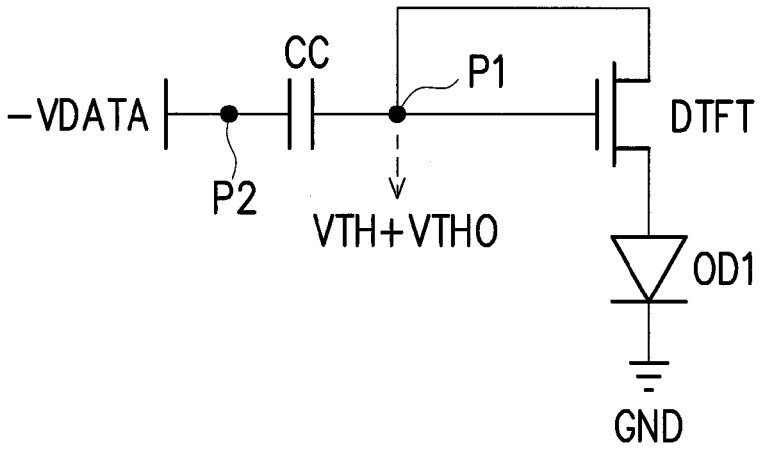

Referring to FIG. 2 and FIG. 2B, after the pre-charge stage is ended, a compensation stage is entered. During the compensation stage, the selecting switch module 210 continually and selectively provides the data signal −VDATA with the negative value to the compensating capacitor CC (the terminal P2) according to the control signal CTRL1, the power switch PSW is turned off according to the control signal CRTL2, and the configuration switch DSW is turned on according to the control signal CTRL1, so that the pixel unit 200 has an equivalent structure shown in FIG. 2B. Now, since the power switch PSW is turned off and the driving transistor DTFT is coupled as the diode connection, a voltage on a terminal P1 coupled between the compensating capacitor CC and the driving transistor DTFT is changed to VTH+VTHO, where VTH is a threshold voltage of the driving transistor DTFT, and VTHO is a threshold voltage of the OLED OD1.

Figure 2C:
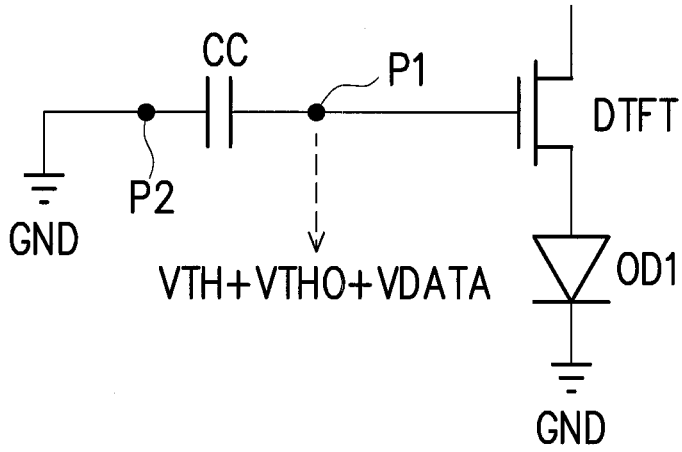

Referring to FIG. 2 and FIG. 2C, after the compensation stage is ended (the voltage on the terminal P1 is stably equal to VTH+VTHO), a data input stage is entered. During the data input stage, the selecting switch module 210 selectively provides the ground voltage GND to the compensating capacitor CC (the terminal P2) according to the control signal CTRL1, i.e. the selecting switch SSW2 is turned on according to the control signal CTRL1 and the selecting switch SSW1 is turned off according to the control signal CTRL1. The power switch PSW and the configuration switch DSW are respectively turned off according to the control signals CTRL2 and CTRL1, so that the pixel unit 200 has an equivalent structure shown in FIG. 2C. Now, since the voltage of the terminal P2 of the compensating capacitor CC coupled to the selecting switch module 210 is transiently increased to the ground voltage GND (0 volt) along with switching operations of the selecting switches SSW1 and SSW2, the voltage of the other terminal P1 of the compensating capacitor CC is also transiently increased to VTH+VTHO+VDATA.

Figure 2D:
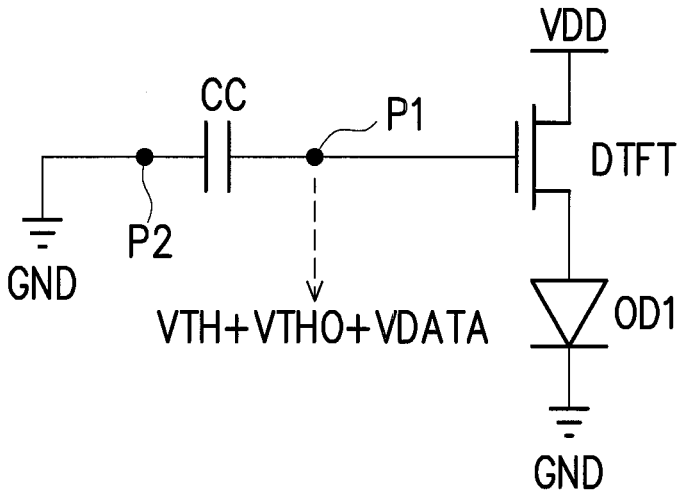

Referring to FIG. 2 and FIG. 2D, after the voltage of the terminal P1 is transiently increased to VTH+VTHO+VDATA, a light exciting stage is entered. During the light exciting stage, the selecting switch module 210 continually provides the ground voltage GND to the compensating capacitor CC (the terminal P2), and the configuration switch DSW is maintained to the turned off state. The power switch PSW is turned on according to the CTRL2, so that the DTFT receives the power voltage VDD to generate a driving current to drive the OLED OD1.

Meanwhile, the voltage of the terminal P1 is maintained to VTH+VTHO+VDATA, so that the driving current I generated by the driving transistor DTFT can be calculated according to a following equation (2):

$$I = \frac{1}{2}K(\text{VGS_DTFT} - VTH)^2 \qquad \text{Equation (2)}$$

$$= \frac{1}{2}K(VTH + VDATA + VTHO - VTHO - VTH)^2$$

$$= \frac{1}{2}K(VDATA)^2$$

Where, VGS_DTFT is a voltage difference between the gate and the source of the driving transistor DTFT, which is equal to the voltage (VTH+VTHO+VDATA) on the terminal P1 minus the threshold voltage (VTHO) of the OLED OD1.

According to the above equation (2), it is known that when the pixel unit 200 of the present embodiment drives the OLED OD1 to emit light, the generated driving current I is unrelated to the threshold voltages of the OLED OD1 and the driving transistor DTFT, so that an influence caused by variations of the threshold voltages of the OLED OD1 and the driving transistor DTFT can be effectively compensated.

Figure 2E:
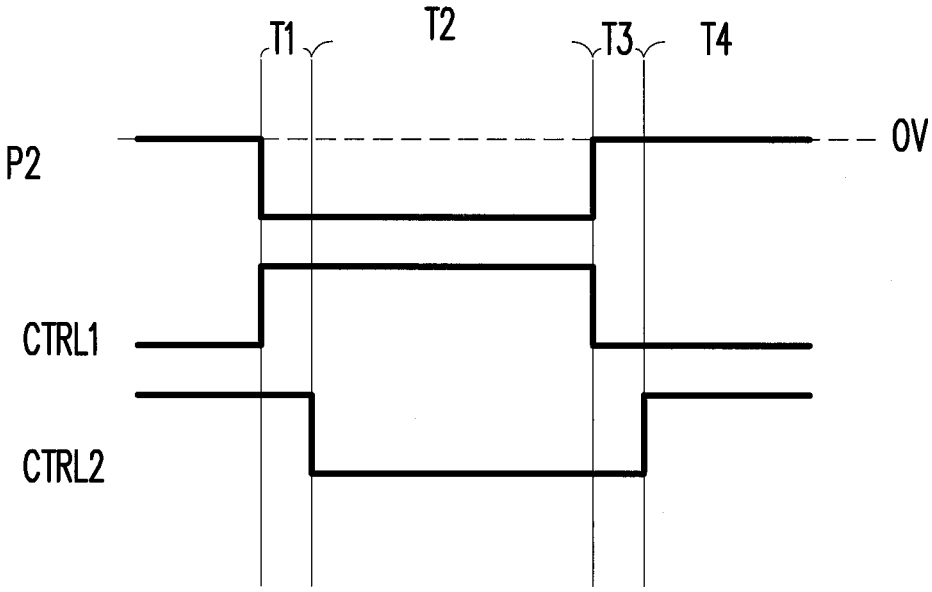
FIG. 2E is a driving timing diagram of the pixel unit 200 according to an embodiment of the present invention.

Referring to FIG. 2 and FIG. 2E, FIG. 2E is a driving timing diagram of the pixel unit 200 according to an embodiment of the present invention. During the pre-charge stage T1, the data signal −VDATA with the negative value is provided to the compensating capacitor CC (the terminal P2), and the control signal CTRL1 with a logic high level and the control signal CTRL2 with the logic high level are provided to turn on the selecting switch SSW2, the configuration switch DSW and the power switch PSW, and turn off the selecting switch SSW1. During the compensation stage T2, the control signal CTRL2 is changed to the logic low level to turn off the power switch PSW. During the data input stage T3, the control signal CTRL1 is changed to the logic low level to provide the ground voltage GND (0 volt) to the compensating capacitor CC (the terminal P2) and turn off the configuration switch DSW. Finally, during the light exciting stage T4, the control signal CTRL2 is changed to the logic high level to turn on the power switch PSW and drive the OLED OD1 to emit light.

Figure 3A:
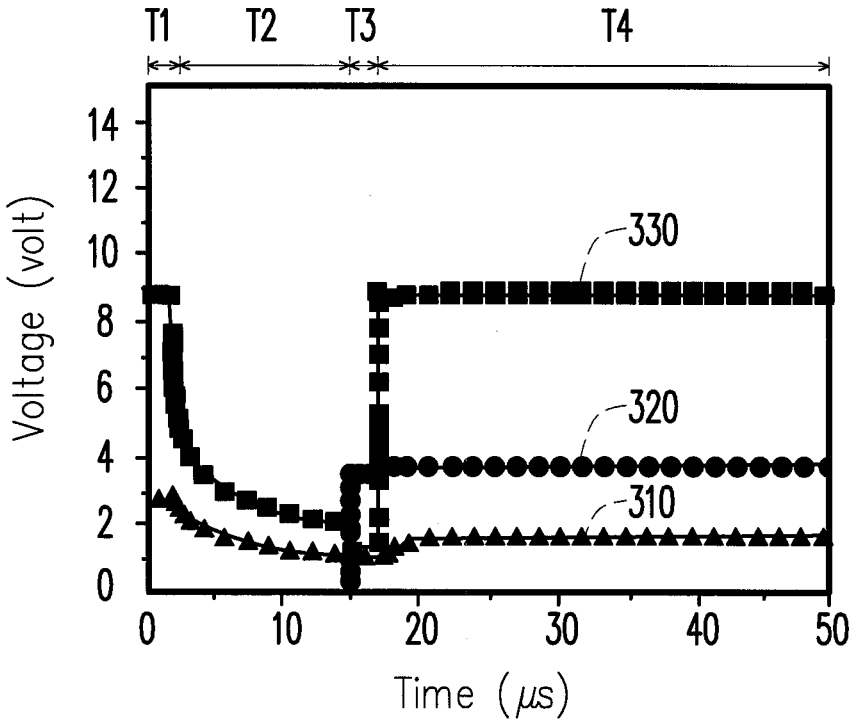
FIG. 3A and FIG. 3B are simulation results of the pixel unit 200 according to an embodiment of the invention.
Figure 3B:
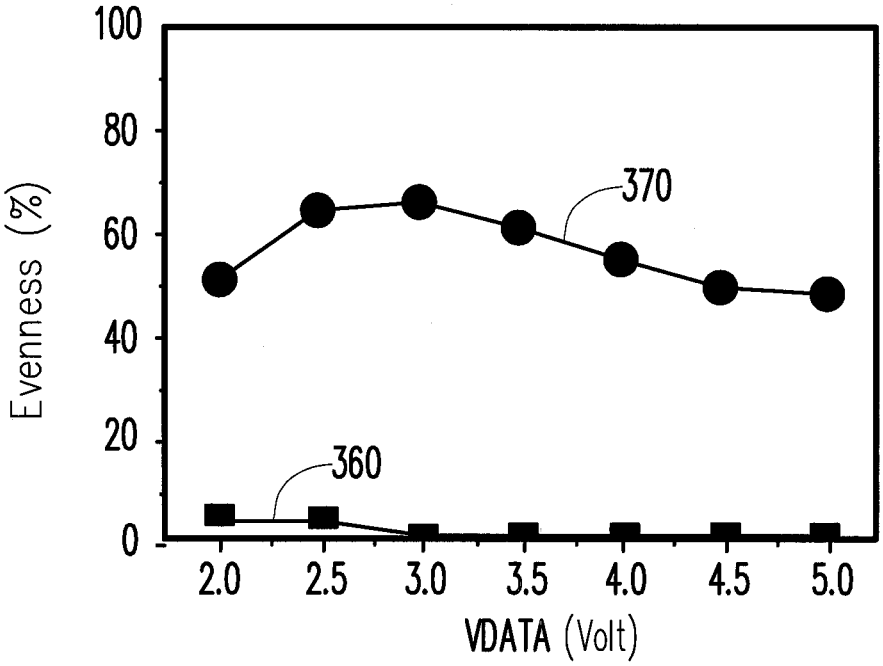

Referring to FIG. 3A and FIG. 3B, FIG. 3A and FIG. 3B are simulation results of the pixel unit 200 according to an embodiment of the invention. In FIG. 3A, a curve 310 represents source voltages of the driving transistor DTFT corresponding to different stages (T1-T4), a curve 320 represents gate voltages of the driving transistor DTFT corresponding to different stages (T1-T4), and a curve 330 represents drain voltages of the driving transistor DTFT corresponding to different stages (T1-T4). In FIG. 3B, simulations of evenness of the driving currents of the pixel unit 200 and the conventional pixel unit 100 in case of ±0.3 volt shifting of the threshold voltage of the driving transistor DTFT are illustrated, in which a curve 370 represents the simulation of the pixel unit 100, and a curve 360 represents the simulation of the pixel unit 200. It is obvious that shifting of the driving current of the pixel unit 200 of the present embodiment caused by the variation of the threshold voltage of the OLED OD1 is very small.

Figure 4:
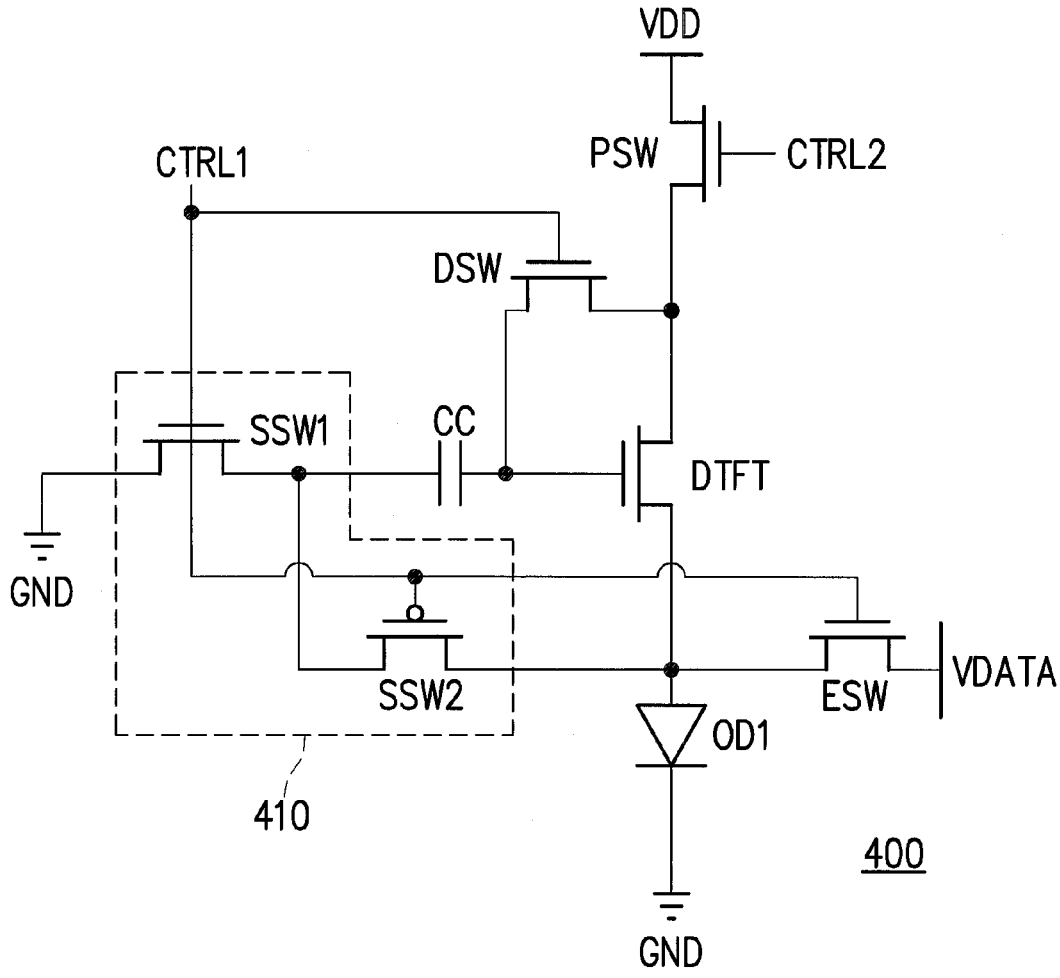
FIG. 4 is a schematic diagram of a pixel unit 400 according to another embodiment of the invention.

Referring to FIG. 4, FIG. 4 is a schematic diagram of a pixel unit 400 according to another embodiment of the invention. The pixel unit 400 is used for driving an OLED OD1. The pixel unit 400 includes a driving transistor DTFT, a compensating capacitor CC, a selecting switch module 410, a power switch PSW, a data voltage switch ESW and a configuration switch DSW. The driving transistor DTFT has a drain, a source and a gate, and the source thereof is coupled to an anode of the OLED OD1, and a cathode of the OLED OD1 is coupled to a ground voltage GND. One terminal of the compensating capacitor CC is coupled to the gate of the driving transistor DTFT, and another terminal of the compensating capacitor CC is coupled to the selecting switch module 410. The selecting switch module 410 is coupled the ground voltage GND and a compensating reference voltage, and provides the ground voltage GND or the compensating reference voltage to the other terminal of the compensating capacitor CC according to a control signal CTRL1. In the present embodiment, the compensating reference voltage is a threshold voltage of the OLED OD1.

In detail, in the present embodiment, the selecting switch module 410 includes a selecting switch SSW1 and a selecting switch SSW2. The selecting switch SSW1 is coupled in series between the ground voltage GND and the compensating capacitor CC, and is turned on or turned off according to the control signal CTRL1. The selecting switch SSW2 is coupled in series between the compensating capacitor CC and the anode of the OLED OD1, and is turned on or turned off according to the control signal CTRL1. It should be noticed that turned on/off states of the selecting switches SSW1 and SSW2 are complementary, namely, when the selecting switch SSW1 is turned on, the selecting switch SSW2 is turned off. Comparatively, when the selecting switch SSW1 is turned off, the selecting switch SSW2 is turned on.

The power switch PSW is coupled between the power voltage VDD and the drain of the driving transistor DTFT, and is controlled by a control signal CTRL2. The configuration switch DSW is coupled between the drain of the driving transistor DTFT and one terminal of the compensating capacitor CC, and is controlled by the control signal CTRL1. When the configuration switch DSW is turned on according to the control signal CTRL1, the driving transistor DTFT is connected in a diode connection. Moreover, the data voltage switch ESW is coupled between the OLED OD1 and a data signal VDATA, and is turned on or turned off according to the control signal CTRL1.

It should be noticed that the driving transistor DTFT, the selecting switches SSW1 and SSW2, the power switch PSW, the data voltage switch ESW and the configuration switch DSW can all be implemented by thin-film transistors. The selecting switches S SW1 and SSW2 can be thin-film transistors with complementary patterns.

Figure 4A:
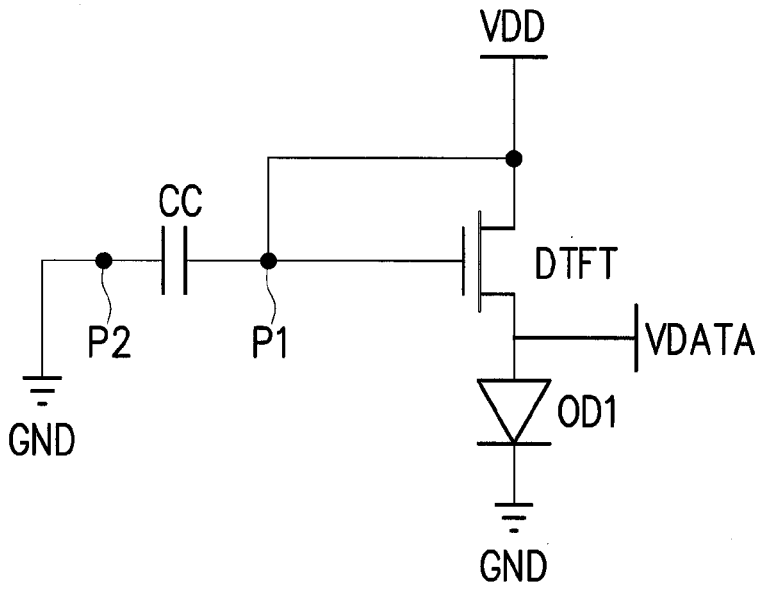
FIGS. 4A-4C are equivalent circuit diagrams of the pixel unit 400 of different stages according to an embodiment of the invention.
Figure 4B:
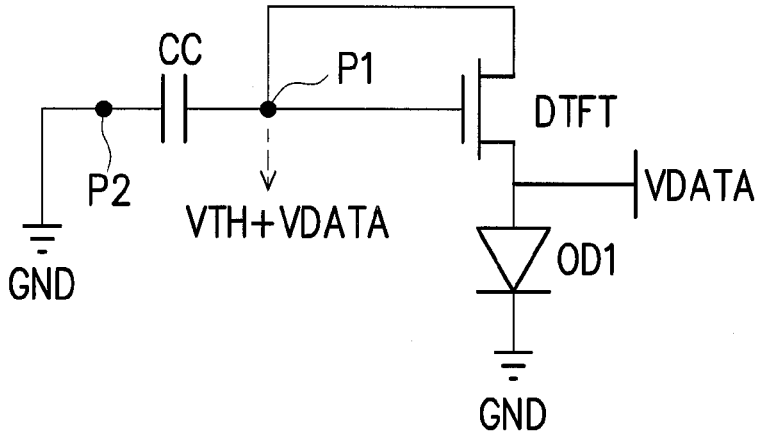
Figure 4C:
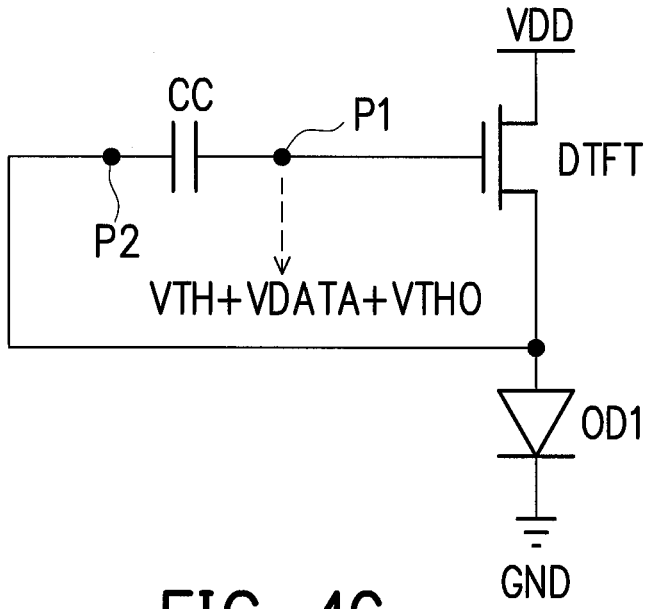

Referring to FIG. 4 and FIGS. 4A-4C for a driving method of the pixel unit 400, and FIGS. 4A-4C are equivalent circuit diagrams of the pixel unit 400 of different stages according to an embodiment of the invention. Referring to FIG. 4 and FIG. 4A, in the beginning of a driving cycle, a pre-charge stage is first entered. During the pre-charge stage, the selecting switch module 410 selectively provides the ground voltage GND to the compensating capacitor CC (a terminal P2) according to the control signal CTRL1. Namely, the selecting switch SSW1 is turned on according to the control signal CTRL1, and the selecting switch SSW2 is turned off according to the control signal CTRL1. The power switch PSW is turned on according to the control signal CTRL2, so that the power voltage VDD is directly connected to the drain of the driving transistor DTFT. The configuration switch DSW is turned on according to the control signal CTRL1, and the data voltage switch ESW is turned on according to the control signal CTRL2, so that the pixel unit 400 has an equivalent structure shown in FIG. 4A.

Referring to FIG. 4 and FIG. 4B, after the pre-charge stage is ended, a data input stage is entered. During the data input stage, the selecting switch module 410 continually and selectively provides the ground voltage GND to the compensating capacitor CC (the terminal P2) according to the control signal CTRL1, the power switch PSW is turned off according to the control signal CRTL2, the configuration switch DSW is turned on according to the control signal CTRL1, and the data voltage switch ESW is turned on according to the control signal CTRL2 and provides the data signal VDATA to the anode of the OLED OD1, so that the pixel unit 400 has an equivalent structure shown in FIG. 4B. Now, since the power switch PSW is turned off and the driving transistor DTFT is coupled as the diode connection, a voltage on the terminal P1 of the compensating capacitor CC coupled to the driving transistor DTFT is changed to VTH+VDATA, where VTH is a threshold voltage of the driving transistor DTFT.

Referring to FIG. 4 and FIG. 4C, after the data input stage is ended (the voltage on the terminal P1 is stably equal to VTH+VDATA), a feedback stage is entered. During the feedback stage, the selecting switch module 410 selectively connects the anode of the OLED OD1 to the to the compensating capacitor CC (the terminal P2) according to the control signal CTRL1, i.e. the selecting switch SSW2 is turned on according to the control signal CTRL1 and the selecting switch SSW1 is turned off according to the control signal CTRL1. The power switch PSW is turned on according to the control signal CTRL2, the configuration switch DSW is turned off according to the control signal CTRL1, and the data voltage switch ESW is turned off according to the control signal CTRL2, so that the pixel unit 400 has an equivalent structure shown in FIG. 4C. Now, since the voltage of the terminal P2 of the compensating capacitor CC coupled to the selecting switch module 410 is increased from the ground voltage GND to the threshold voltage VTHO of the OLED OD1 along with switching operations of the selecting switches SSW1 and SSW2, the voltage of the terminal P1 is synchronously increased to VTH+VDATA+VTHO. Namely, during the feedback stage, the gate of the driving transistor DTFT receives the voltage of VTH+VDATA+VTHO, and accordingly generates a driving current to drive the OLED OD1. Moreover, according to the equation (2), it is known that such driving current is unrelated to the threshold voltages of the OLED OD1 and the driving transistor DTFT.

Figure 4D:
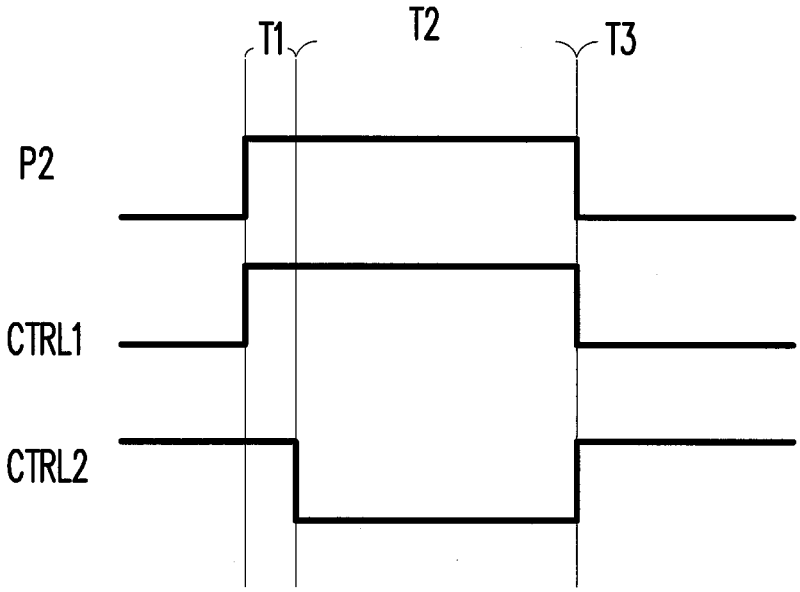
FIG. 4D is a driving timing diagram of the pixel unit 400 according to an embodiment of the present invention.

Referring to FIG. 4 and FIG. 4D, FIG. 4D is a driving timing diagram of the pixel unit 400 according to an embodiment of the present invention. During the pre-charge stage T1, the data signal VDATA is provided to the compensating capacitor CC (the terminal P2), and the control signal CTRL1 with the logic high level and the control signal CTRL2 with the logic high level are provided to turn on the selecting switch SSW1, the configuration switch DSW, the data voltage switch ESW and the power switch PSW, and turn off the selecting switch SSW2. During the data input stage T2, the control signal CTRL2 is changed to the logic low level to turn off the power switch PSW. During the feedback stage T3, the control signal CTRL1 is changed to the logic low level to connect the anode of the OLED OD1 to the terminal P2 and provide the threshold voltage of the OLED OD1 to serve as the compensating reference voltage.

Figure 5A:
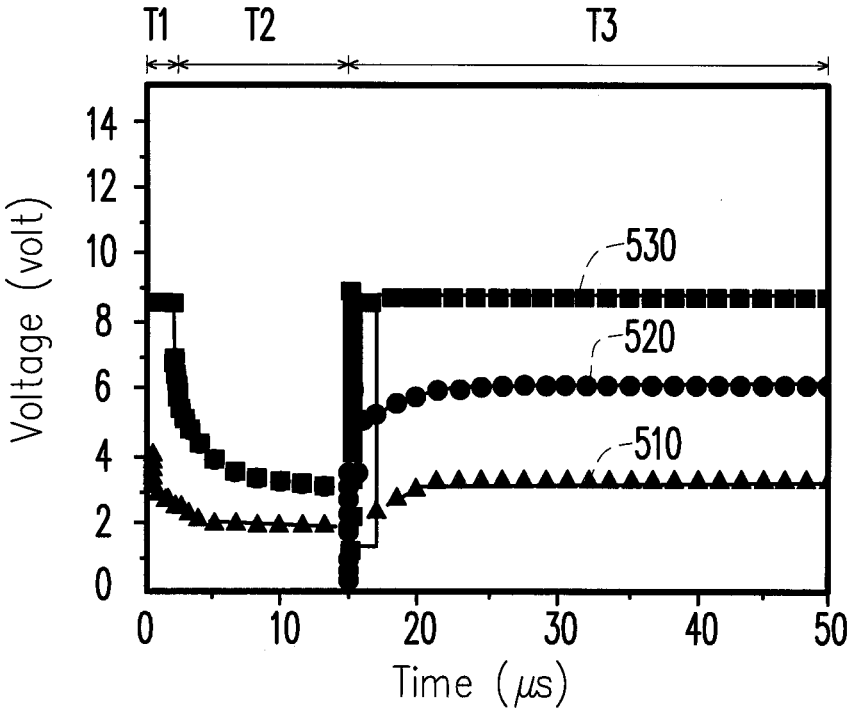
FIG. 5A and FIG. 5B are simulation results of the pixel unit 400 according to an embodiment of the invention.
Figure 5B:
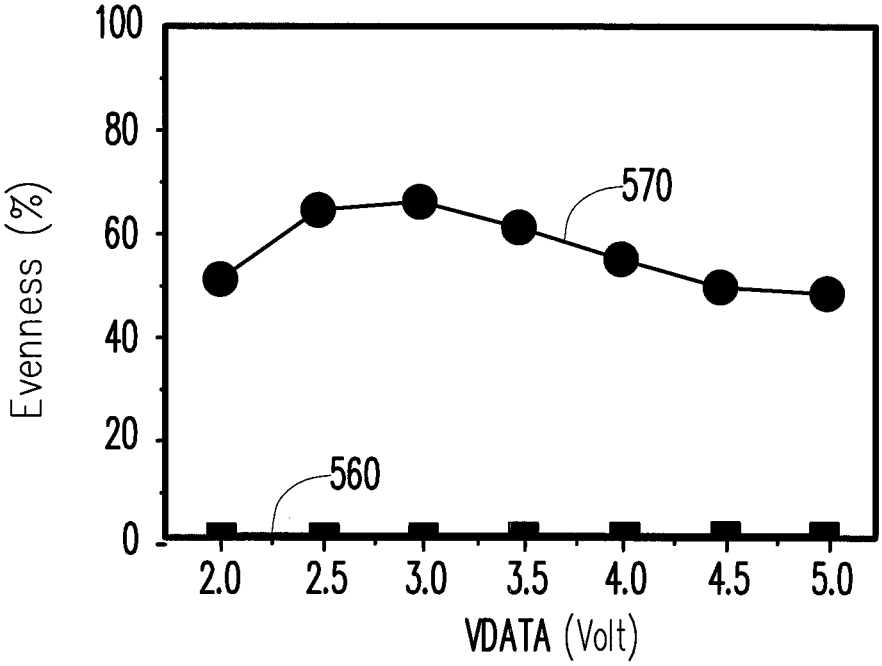

Referring to FIG. 5A and FIG. 5B, FIG. 5A and FIG. 5B are simulation results of the pixel unit 400 according to an embodiment of the invention. In FIG. 5A, a curve 510 represents source voltages of the driving transistor DTFT corresponding to different stages (T1-T3), a curve 520 represents gate voltages of the driving transistor DTFT corresponding to different stages (T1-T3), and a curve 530 represents drain voltages of the driving transistor DTFT corresponding to different stages (T1-T3). In FIG. 5B, simulations of evenness of the driving currents of the pixel unit 400 and the conventional pixel unit 100 in case of ±0.3 volt shifting of the threshold voltage of the driving transistor DTFT are illustrated, in which a curve 570 represents the simulation of the pixel unit 100, and a curve 560 represents the simulation of the pixel unit 400. It is obvious that shifting of the driving current of the pixel unit 400 of the present embodiment caused by the variation of the threshold voltage of the OLED OD1 is relatively less.

Figure 6:
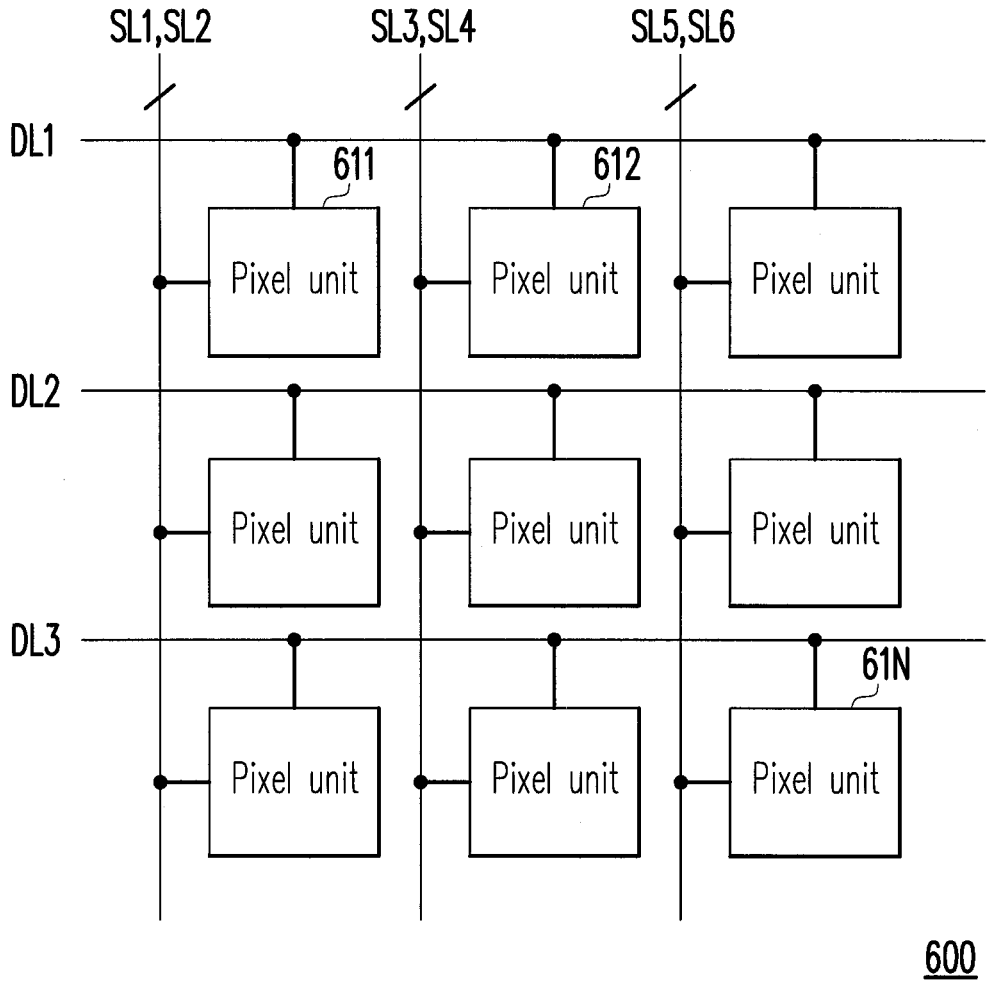
FIG. 6 is a schematic diagram of an OLED display panel 600 according to still another embodiment of the invention.

Referring to FIG. 6, FIG. 6 is a schematic diagram of an OLED display panel 600 according to still another embodiment of the invention. The OLED display panel 600 includes a plurality of pixel units 611-61N. The pixel units 611-61N are arranged in an array for respectively driving an OLED. The pixel units 611-61N can be implemented by one of the pixel unit 200 or 400 of the aforementioned embodiment. The pixel units 611-61N are arranged between a plurality of scan lines SL1-SL6 and a plurality of data lines DL1-DL3. Where, the data lines DL1-DL3 are respectively used for transmitting the data signal VDATA or the data signal −VDATA with the negative value, and the scan lines SL1-SL6 are respectively used for transmitting the control signal CTRL1 or CTRL2.

In summary, in the invention, the selecting switch module and a plurality of switches are used to change connection relations of the circuit components in the pixel unit during different stages, so that during a stage that the driving transistor generates the driving current, the driving current can be generated according to the gate voltage of the driving transistor without being influenced by variations of the threshold voltages of the driving transistor and the OLED, so as to effectively resolve a problem of unstable brightness of the OLED caused by shifting of the threshold voltages of the driving transistor and the OLED.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A pixel unit for driving an organic light emitting diode (OLED), comprising:

a driving transistor, having a drain, a source and a gate, wherein the source of the driving transistor is coupled to the OLED, wherein the driving transistor is an N type transistor;

a compensating capacitor, having one terminal coupled to the gate of the driving transistor;

a selecting switch module, coupled to another terminal of the compensating capacitor, a ground voltage and a compensating reference voltage, the selecting switch module is used for providing the ground voltage or the compensating reference voltage to the other terminal of the compensating capacitor according to a first control signal, wherein the selecting switch module comprises:

a first selecting switch, coupled in series between the ground voltage and the compensating capacitor, the first selecting switch is turned on or turned off according to the first control signal; and a second selecting switch, having one terminal coupled to the compensating capacitor, and another terminal directly coupled to the OLED, wherein a threshold voltage of the OLED is the compensating reference voltage, the second selecting switch is turned on or turned off according to the first control signal, and turned on/off states of the second selecting switch and the first selecting switch are complementary;

a power switch, coupled between a power voltage and the drain of the driving transistor, and the power switch is controlled by a second control signal;

a configuration switch, coupled between the drain of the driving transistor and a terminal of the compensating capacitor coupled to the gate of the driving transistor, and the configuration switch is controlled by the first control signal; and a data voltage switch, directly coupled between the OLED and a data signal, the data voltage switch is turned on or turned off according to the first control signal, wherein during a pre-charge stage, the selecting switch module selectively provides the ground voltage to the compensating capacitor according to the first control signal, the power switch is turned on according to the second control signal, the configuration switch and the data voltage switch are turned on according to the first control signal, and the configuration switch and the data voltage switch are different switches.

2. An organic light emitting diode (OLED) display panel, comprising:

a plurality of pixel units, arranged in an array, for driving a plurality of organic light emitting diodes (OLEDs), and each of the pixel units comprising:

a driving transistor, having a drain, a source and a gate, wherein the source is coupled to the OLED, wherein the driving transistor is an N type transistor;

a compensating capacitor, having one terminal coupled to the gate of the driving transistor;

a selecting switch module, coupled to another terminal of the compensating capacitor, a ground voltage and a compensating reference voltage, for providing the ground voltage or the compensating reference voltage to the other terminal of the compensating capacitor according to a first control signal, wherein the selecting switch module comprises:

a first selecting switch, coupled in series between the ground voltage and the compensating capacitor, the first selecting switch is turned on or turned off according to the first control signal; and a second selecting switch, having one terminal coupled to the compensating capacitor, and another terminal directly coupled to the OLED, wherein a threshold voltage of the OLED is the compensating reference voltage, the second selecting switch is turned on or turned off according to the first control signal, and turned on/off states of the second selecting switch and the first selecting switch are complementary;

a power switch, coupled between a power voltage and the drain of the driving transistor, and controlled by a second control signal;

a configuration switch, coupled between the drain of the driving transistor and one terminal of the compensating capacitor, and controlled by the first control signal; and a data voltage switch, directly coupled between the OLED and a data signal, the data voltage switch is turned on or turned off according to the first control signal, wherein during a pre-charge stage, the selecting switch module selectively provides the ground voltage to the compensating capacitor according to the first control signal, the power switch is turned on according to the second control signal, the configuration switch and the data voltage switch are turned on according to the first control signal, and the configuration switch and the data voltage switch are different switches.

* * * * *